US012599170B2

(12) United States Patent
Tan

(10) Patent No.: US 12,599,170 B2
(45) Date of Patent: Apr. 14, 2026

(54) CARTRIDGE FOR A VAPOUR GENERATING SYSTEM

(71) Applicant: JT International SA, Geneva (CH)

(72) Inventor: Hee Khiem Tan, Butterworth (MY)

(73) Assignee: JT International SA (CH)

( * ) Notice: Subject to any disclaimer, the term of this patent is extended or adjusted under 35 U.S.C. 154(b) by 434 days.

(21) Appl. No.: 18/020,192

(22) PCT Filed: Aug. 9, 2021

(86) PCT No.: PCT/EP2021/072133

§ 371 (c)(1),
(2) Date: Feb. 7, 2023

(87) PCT Pub. No.: WO2022/034006

PCT Pub. Date: Feb. 17, 2022

(65) Prior Publication Data

US 2023/0292833 A1 Sep. 21, 2023

(30) Foreign Application Priority Data

Aug. 10, 2020 (WO) ..... PCT/CN2020/108281

(51) Int. Cl.
*A24F 40/42* (2020.01)
*A24F 40/10* (2020.01)
*A24F 40/46* (2020.01)

(52) U.S. Cl.
CPC ..... *A24F 40/42* (2020.01); *A24F 40/10* (2020.01); *A24F 40/46* (2020.01)

(58) Field of Classification Search
CPC ..... A24F 40/10; A24F 40/42
See application file for complete search history.

(56) References Cited

U.S. PATENT DOCUMENTS

| | | | | |
|---|---|---|---|---|
| 2018/0077967 | A1 | 3/2018 | Hatton et al. | |
| 2018/0146709 | A1* | 5/2018 | Bessant | A24F 40/40 |
| 2019/0274359 | A1* | 9/2019 | Jain | H05B 1/0297 |
| 2021/0219605 | A1* | 7/2021 | Bayat | A24F 40/53 |
| 2022/0015433 | A1* | 1/2022 | Saygili | A24F 40/42 |

FOREIGN PATENT DOCUMENTS

| | | | | |
|---|---|---|---|---|
| CN | 205813569 | U | 12/2016 | |
| WO | 2020115302 | A1 | 6/2020 | |
| WO | 2020115321 | A1 | 6/2020 | |
| WO | WO-2022034006 | A2 * | 2/2022 | A24F 40/42 |
| WO | WO-2022034008 | A1 * | 2/2022 | A24F 40/42 |

OTHER PUBLICATIONS

International Search Report for Application No. PCT/EP2021/072133 mailed Mar. 16, 2022, pp. 1-6.

* cited by examiner

*Primary Examiner* — Philip C Tucker
(74) *Attorney, Agent, or Firm* — Lerner David LLP

(57) ABSTRACT

A cartridge for a vapour generating system such as an e-cigarette includes a layer of mesh disposed across the airflow path, wherein at least a surface of the mesh includes a water-repellent material. The mesh permits the flow of air along the airflow path, while resisting the passage of condensed vapour-generating liquid that might leak from either the air inlet or air outlet. The water-repellent material may be a surface coating of a fluoropolymer such as PTFE or a ceramic nano-coating. Preferably the mesh has an average pore size less than 30 μm. The mesh may be a generally planar sheet supported in a prefabricated cartridge closure assembly, which also defines the air inlet.

13 Claims, 3 Drawing Sheets

CARTRIDGE FOR A VAPOUR GENERATING SYSTEM

CROSS-REFERENCE TO RELATED APPLICATIONS

The present application is a national phase entry under 35 U.S.C. § 371 of International Application No. PCT/EP2021/072133, filed Aug. 9, 2021, published in English, which claims priority to International Application No. PCT/CN2020/108281 filed Aug. 10, 2020, the disclosures of which are incorporated herein by reference.

TECHNICAL FIELD

The present disclosure relates generally to a cartridge for a vapour generating system configured to heat a liquid to generate a vapour which cools and condenses to form an aerosol for inhalation by a user of the system. The present disclosure also relates to a vapour generating system that comprises a vapour generating device and a cartridge configured to be used with the vapour generating device.

BACKGROUND

The term vapour generating system (or more commonly electronic cigarette or e-cigarette) refers to handheld electronic apparatus that is intended to simulate the feeling or experience of smoking tobacco in a traditional cigarette. Electronic cigarettes work by heating a vapour generating liquid to generate a vapour that cools and condenses to form an aerosol which is then inhaled by the user. Accordingly, using e-cigarettes is also sometimes referred to as "vaping". The vapour generating liquid may, for example, comprise polyhydric alcohols and mixtures thereof such as glycerine or propylene glycol. The vapour generating liquid may contain nicotine.

In general terms, a vapour is a substance in the gas phase at a temperature lower than its critical temperature, which means that the vapour can be condensed to a liquid by increasing its pressure without reducing the temperature, whereas an aerosol is a suspension of fine solid particles or liquid droplets, in air or another gas. It should, however, be noted that the terms 'aerosol' and 'vapour' may be used interchangeably in this specification, particularly with regard to the form of the inhalable medium that is generated for inhalation by a user.

Typical e-cigarette vaporizing units, i.e. systems or subsystems for vaporizing the vapour generating liquid, utilize a heating element to produce vapour from liquid stored in a capsule, tank or reservoir. When a user operates the e-cigarette, liquid from the reservoir is transported through a liquid transfer element, e.g. a cotton wick or a porous ceramic block, and is heated by the heating element to produce a vapour, which cools and condenses to form an aerosol that can be inhaled. To facilitate the ease of use of e cigarettes, removable cartridges are often employed. These cartridges are often configured as "cartomizers", which means an integrated component comprising a liquid store, a liquid transfer element and a heater. Electrical connectors may also be provided to establish an electrical connection between the heating element and a power source. Such cartridges may be disposable, i.e. not intended to be capable of reuse after the supply of liquid in the reservoir has been exhausted. Alternatively, they may be reusable, being provided with means allowing the reservoir to be refilled with a new supply of vapour generating liquid. Particularly in the case of disposable cartridges, it is desirable to reduce the number and complexity of their components, thereby reducing waste and making the manufacturing process simpler and cheaper.

A cartridge for an e-cigarette typically comprises an air inlet at a first end and an air outlet at a second, opposite end. (Considered from the viewpoint of a user of the system, the first end of the cartridge may also be termed the distal end and the second end of the cartridge may also be termed the proximal end or mouth end.) The first end of the cartridge is configured to be releasably connected to the vapour generating device, which may, for example, contain a power source and control electronics. A user inhales through a mouthpiece at the second end of the cartridge to draw air along an airflow path from the air inlet to the air outlet. The airflow path passes through a vaporization chamber, where liquid vaporized by the heating element mixes with the air. The vapour cools as it passes from the vaporization chamber towards the air outlet and at least partly condenses into small droplets that form an aerosol in the stream of inhaled air.

Droplets from the aerosol may impact and adhere to the walls of the vaporization chamber or other parts of the airflow path. Some vaporized liquid may also re-condense directly on the cooler walls. As the droplets accumulate on the walls, they may coalesce to form a mobile liquid that can flow under the influence of gravity or the moving air towards the air inlet or air outlet. Further, some liquid in the vaporization chamber may fail to vaporize and instead accumulate in the chamber, from where it can flow in a similar way towards the air inlet or air outlet. It is undesirable that such liquid should be permitted to leak from the air inlet or air outlet to the exterior of the vapour generating system, where it may be unsightly, risk causing stains or otherwise be unacceptable to the user. Additionally or alternatively, the leaked liquid may find its way into the power source or the control electronics of the vapour generating device and cause damage.

SUMMARY OF THE INVENTION

The invention provides a cartridge for a vapour generating system, the cartridge comprising: an air inlet; a vaporization chamber; an air outlet; an airflow path extending from the air inlet through the vaporization chamber to the air outlet; and a mesh disposed across the airflow path; wherein at least the surface of the mesh comprises a water-repellent material.

The mesh acts to permit air to flow through the mesh, along the airflow path, while simultaneously preventing or obstructing the passage of liquid droplets of a size at least comparable to the pores of the mesh. As the mesh is disposed across the airflow path, it lies between the vaporization chamber and either the air inlet or the air outlet, therefore the mesh obstructs the flow of condensed liquid from the vaporization chamber towards the air inlet or air outlet, respectively, and helps to prevent leakage from the device.

The mesh may be formed from any suitable material that can maintain its properties in the warm and humid environment of a cartridge for a vapour generating system, for example stainless steel. The mesh may be formed with various structures that are capable of filling the cross-section of the airflow path, while providing openings or pores that permit air travelling along the airflow path to pass through the mesh. For example, the mesh may comprise a perforated sheet or it may be formed in various ways from an array of fibres, for example by bonding them into a net-like structure, by knitting or weaving them in a pre-defined pattern or by entangling them in a non-woven structure. Thus the pores that permit air to pass through the mesh may be individually defined or may arise from the random or semi-random arrangement of fibres that create a network of interconnecting passages between them.

The layer of mesh is preferably generally planar, which makes it easy to fabricate and does not require it to be formed of a rigid material that can form a self-supporting three-dimensional component. The generally planar layer of mesh may therefore be formed from a flexible material. It may be prevented from flexing in the cartridge closure assembly by being clamped between the cartridge cover and the gasket.

The vapour generating liquid in an e-cigarette is typically based on aqueous or polar solvents such as alcohols, with additives including nicotine and flavourings. The liquid forms droplets because of the surface tension and if the droplets are larger than the pore size of the mesh, the liquid cannot pass through. Considering the situation at a more detailed level, passage of the liquid is resisted because of the energy required to achieve the increase in the curvature and surface area that are necessary to deform a large droplet so that it can squeeze through a smaller pore. However, if the surface of the mesh had an affinity for water then the situation would change: the liquid might wet the surface instead of remaining as a discrete droplet, allowing it to pass through the pore more easily. It could even be drawn into the pore by capillary action. Therefore, for the present invention, the material of the surface of the mesh should be water-repellent. That term is used in its normal sense, as a synonym for "hydrophobic", meaning that the material has no affinity for water or other polar molecules such as glycerine or propylene glycol that are the dominant constituents of the vapour generating liquid in e-cigarettes. The term does not imply that there should be a repulsive force between the material and water or other polar compounds.

If the material of the mesh itself is not water-repellent, then it may be coated with a different material to provide the required water-repellent properties. The water-repellent properties may result from the chemical nature and/or physical structure of the coating. Various water-repellent coatings are available, including those based on silicone.

In some preferred embodiments of the invention, the water-repellent material is a ceramic coating. In particular, a thin layer of ceramic known as a "nano-coating" can reduce the roughness of the surface on the nanometre scale, which helps to prevent water droplets adhering to it. A preferred ceramic coating comprises silicon dioxide, also known as "liquid glass", which has water-repellent properties.

In other preferred embodiments of the invention, the water-repellent material is a fluoropolymer. The family of fluoropolymers includes water-repellent materials suitable for use with the invention. In particular, a preferred fluoropolymer for use as the water-repellent material is polytetrafluoroethylene (PTFE), which is readily obtainable and widely used for industrial coatings.

Preferred embodiments of the invention further comprise a heater in the vaporization chamber, which is used to raise the temperature of the vapour generating liquid in order to vaporize it. Certain water-repellent materials such as fluoropolymers may degrade when exposed to high temperatures and there is a risk that they could emit fluorine-containing compounds that should not be inhaled by the user of the device. Therefore, in accordance with a preferred embodiment of the invention, the mesh is disposed such that the temperature of the mesh remains low enough to avoid thermal degradation of the water-repellent material when the heater is in operation. This typically involves spacing the mesh far enough from the heater that it is not exposed to excessive thermal radiation, as well as ensuring that there is no thermally conductive path from the heater to the mesh. In some designs, the airflow path may change direction between the heater and the mesh, whereby the mesh is not directly exposed to radiation from the heater. Many vapour generating devices also incorporate a flow sensor, which causes the heater to be activated only when the sensor determines that air is being drawn through the device. Accordingly, because the mesh is disposed between the air inlet and the vaporizing chamber, the inward flow of cool air will help to maintain the mesh at a low temperature whenever the heater is in operation.

If the water-repellent material is PTFE, then the temperature of the mesh preferably remains below 270° C. when the heater is in operation. If maintained below this temperature, PTFE should not undergo significant thermal degradation during the typical lifetime of a cartridge for a vapour generating device.

The average pore size of the mesh is a significant factor in its effectiveness. The size of a pore may be defined as the diameter of the largest sphere that can pass through the mesh via that pore. The average pore size is then the mean of the pore size of all the pores that pass through the mesh.

A smaller pore size will be more effective at obstructing the passage of liquid droplets but may also more strongly obstruct the flow of air, thereby increasing the "resistance to draw" (RTD) of the e-cigarette, which is an important characteristic of the device for users. The RTD will also be affected by the proportion of open space to solid material provided by the mesh, which can in principle be varied independently of the pore size. Put simply, if the pores are made smaller, then more of them may be provided to maintain an acceptable RTD. In practice, the range of pore sizes and the proportion of the area that they occupy may be limited by the materials and technology used to form the mesh. The mesh is typically in the form of layer, having a width greater than its thickness. To some extent, a larger pore size can be compensated by forming longer or more convoluted pores, e.g. in a greater thickness of mesh. The design of any particular cartridge in accordance with the invention will involve a balance between these various factors and the associated economic considerations. The mesh used in the present invention preferably has an average pore size less than 300 μm. More preferably, the mesh has an average pore size less than 30 μm.

In a preferred embodiment, the mesh may be disposed across the airflow path between the air inlet and the vaporization chamber. The mesh therefore helps to reduce leakage of liquid from the air inlet, where it is at greatest risk of penetrating into the power source or control electronics and causing damage. Also, the vaporization chamber is typically located closer to the air inlet than the air outlet so this is where the need for containment of the liquid is greatest.

A preferred embodiment of the invention further comprises a cartridge closure assembly, which comprises the air inlet and the mesh. If the mesh is disposed across the airflow path between the air inlet and the vaporization chamber, then providing a prefabricated assembly that comprises both the air inlet and the mesh provides an easy and convenient way to manufacture and assemble the cartridge. The cartridge closure assembly preferably comprises: a cartridge cover comprising the air inlet; a gasket; and a layer of the mesh mounted between the cartridge cover and the gasket. The gasket forms an air- and water-tight seal around the perimeter of the cartridge closure assembly. The gasket may also form a distal wall of the vaporization chamber.

In a further preferred embodiment of the invention, the cartridge is a three-part cartridge comprising: the cartridge closure assembly as a first part; a second part to which the cartridge closure assembly is attached, the second part forming a proximal wall of the vaporization chamber; and a third part to which the second part is attached, the third part comprising a reservoir for a vapour generating liquid. This is a convenient arrangement for the easy assembly and filling of the cartridge during its manufacturing process. The gasket of the cartridge closure assembly is preferably clamped against the distal end of the vaporization chamber to prevent air or liquid leaking between the first and second parts.

The invention further provides a vapour generating system, which comprises a cartridge as previously defined and a vapour generating device comprising a power source. A distal end of the cartridge is releasably connected to the vapour generating device and electrodes couple the power source, via a control circuit, to a heater in the cartridge. If the layer of mesh is provided across the airflow path, adjacent to the air inlet at the distal end of the cartridge, the invention therefore reduces the risk that condensed liquid from the vaporization chamber may leak from the air inlet and cause damage to the power source or control circuit.

Figure 1:
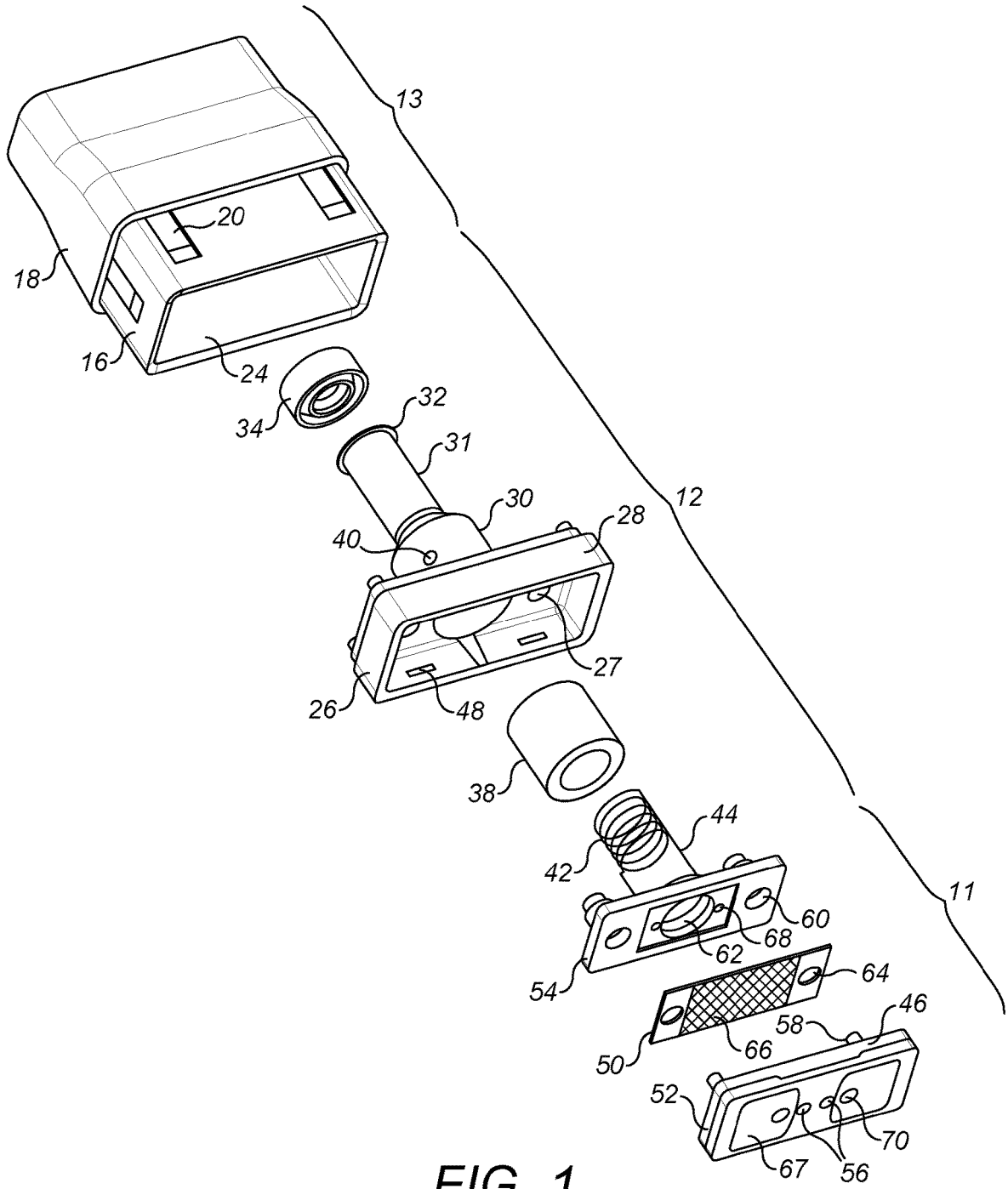
FIG. 1 is an exploded perspective view of a cartridge according to an embodiment of the present invention.
Figure 2:
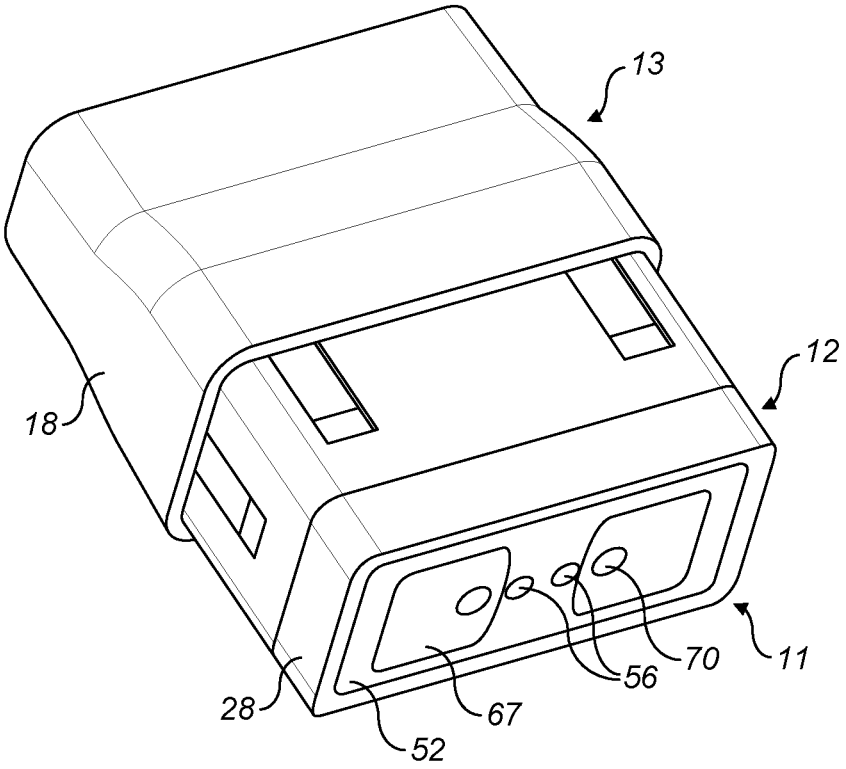
FIG. 2 is a perspective view of the cartridge of FIG. 1 when assembled.

The cartridge 10 comprises three main parts. They will be described in more detail below but, in general terms, a first part 11 serves as a cartridge closure assembly, a second part 12 provides heating and vaporization apparatus and a third part 13 holds a store of a vapour generating liquid and provides a mouthpiece. The three-part configuration of the cartridge 10 is a convenient arrangement for the easy assembly and filling of the cartridge during its manufacturing process. It can be seen from FIG. 1 that the parts can be assembled by inserting them in sequence along the longitudinal axis of the cartridge 10 to arrive at an assembled cartridge with the appearance shown in FIG. 2. This design keeps the number of components of the cartridge small and facilitates sealing between the parts to reduce the risk of air or liquid leaking between them during use.

The third part 13 of the cartridge 10 comprises a housing 16, which may be moulded as a single piece from a plastic material such polycyclohexylenedimethylene terephthalate glycol (PCT-G). An external wall 18 of the housing 16 forms the exterior of the assembled cartridge 10 at its proximal end. In the proximal end face of the housing 16 (hidden from view in the drawings) there is an aperture that serves as a conventional mouthpiece, through which a user of the e-cigarette can draw air through the device. The exterior of the housing 16 also provides means 20 for retaining the cartridge 10 when it is attached to a vapour generating device 22 as shown schematically in FIG. 3. The retaining means may include any suitable means for retention, for example friction pads, clips, magnets or—in alternative, cylindrical embodiments—a screw thread or bayonet fitting. An interior of the housing 16 forms a tank or reservoir 24 for storing a vapour generating liquid. A distal end of the reservoir 24 is open to allow the reservoir to be filled with the liquid and to allow the second part 12 to be inserted.

The second part 12 of the cartridge 10 comprises a reservoir cover 26 a proximal wall 27 of which covers the distal opening of the reservoir 24 when the second and third parts 12,13 of the cartridge 10 are assembled together. The second and third parts 12,13 may be ultrasonically welded to one another to ensure an air- and water-tight seal between them and to prevent the reservoir 24 being re-opened by a user, e.g. to re-fill it if the cartridge is not intended to be reusable. Side walls 28 of the reservoir cover 26 form part of the exterior of the assembled cartridge 10 near its distal end. They also provide a seat for the first part 11 of the housing 10 as described below.

An aperture in the proximal wall 27 of the reservoir cover 26 opens into a vaporization chamber 30, which in this embodiment is in the form of an axially aligned cylinder. Other shapes of the vaporization chamber 30 are possible. The reservoir cover 26 and the vaporization chamber 30 may be moulded as an integral part or may, as shown, be formed by the attachment of two components in a pre-assembly step. That allows the two components to be formed from different materials, for example the reservoir cover may be moulded from a plastic such as PCT-G, while the vaporization chamber 30 may be formed from stainless steel, which is able to withstand higher temperatures. The vaporization chamber 30 is located within the reservoir 24. A proximal end of the vaporization chamber 30 is coupled to a cylindrical tube 31 that has a smaller diameter than the vaporization chamber 30. The tube 31 extends in the proximal direction through the reservoir 24 so that an air outlet 32 at the end of the tube 31 is located adjacent to the mouthpiece. A sealing gasket 34, for example of silicone rubber, couples the air outlet 32 to the mouthpiece, while sealing around the mouthpiece to prevent liquid leaking from the reservoir 24 to the mouthpiece.

The cylindrical vaporization chamber 30 can accommodate a hollow, cylindrical liquid transport element 38. The liquid transport element 38 is permeable to the liquid and may comprise, for example, a ceramic core or a wick formed from a textile material such as cotton. One or more—preferably two or more—openings 40 pierce the side walls of the vaporization chamber 30 but are occluded by the liquid transport element 38. Vapour generating liquid from the reservoir 24 can therefore pass through the openings 40 into the vaporization chamber 30 only by diffusing through the material of the liquid transport element 38, which thereby serves to regulate the flow of the liquid and to distribute it along and around the interior of the vaporization chamber 30.

The second part 12 of the housing 10 further comprises a heater, which in this embodiment is in the form of an axially aligned, cylindrical coil 42. Two wires 44 extend in the distal direction from the ends of the coil to serve as electrical terminals, through which electric current may be delivered to the coil. In other embodiments the heater may take other forms. For example, it may be an electrically connected, resistive element of a different shape or orientation; an electrical trace laid down on a surface in the vaporization chamber 30, such as the surface of a ceramic fluid transport element 38; or a coil that is unconnected and heated by induction.

The heater coil 42 of the present embodiment fits inside the liquid transport element 38 so that, when operated, it raises the temperature of the inner surface of the liquid transport element 38. The raised temperature causes liquid that has diffused through the element 38 to vaporize from its surface into a stream of air passing through the vaporization chamber 30 to the tube 31. As the air flows along the tube 31, the vapour cools and condenses into small droplets suspended in the airstream, thereby forming an aerosol that can be inhaled by the user through the mouthpiece. Some droplets may also condense or impact on the walls of the tube 31 or the vaporization chamber 30. The droplets of liquid may coalesce and flow towards the air inlet or the air outlet 32, giving rise to a risk that liquid may leak to the exterior of the device.

The distal end of the cartridge 10 is formed by the first part 11, which serves as a cartridge closure assembly. The first part 11 fits into the distal end of the second part 12 and is retained, for example, by lugs 46 on the first part 11 that snap into recesses 48 in the side walls 28 of the reservoir cover 26 of the second part 12, or by any other suitable means. Preferably, the first part 11 is designed to be difficult for a user to remove from the second part 12, in order to prevent tampering with the device.

The cartridge closure assembly comprises a layer of mesh 50, which is sandwiched between a cartridge cover 52 and a gasket 54. When the cartridge 10 is assembled, the cartridge cover 52 forms the exterior surface of the cartridge at its distal end. The cartridge cover 52 comprises an air inlet 56, which admits air into the distal end of an airflow path that passes through the vaporization chamber 30 and the tube 31 to the air outlet 32 and the mouthpiece at the proximal end of the cartridge 10. In the illustrated embodiment, the air inlet 56 comprises a pair of apertures close to the centre of the distal face of the cartridge cover 52 but it may take many other forms. When the cartridge is attached to a vapour generating device 22, the air inlet 56 may receive air via supply channels (not illustrated) in the vapour generating device, the arrangement of which may dictate the form and position of the air inlet 56.

The cartridge cover 52 comprises a pair of posts 58 that extend from its proximal surface and are received in a corresponding pair of holes 60 in the gasket 54 to secure the cartridge cover 52 and the gasket 54 together. The gasket comprises a central opening 62 aligned with the air inlet 56 to provide part of the airflow path from the air inlet 56 to the vaporization chamber 30. The layer of mesh 50 is sandwiched between the cartridge cover 52 and the gasket 54 and is clamped tightly between them. The mesh layer 50 may also be provided with a pair of holes 64, which receive the posts 58 of the cartridge cover 52 and ensure that the mesh layer 50 is correctly located and secured. Because the layer of mesh 50 is clamped between the cartridge cover 52 and the gasket 54, it does not need to be a self-supporting or rigid structure. The layer of mesh 50 is preferably formed from a sheet material that is generally planar and may be flexible. As illustrated, the mesh layer 50 need not comprise a mesh structure 66 over its entire area; for example, the layer 50 may be continuous in the area surrounding the holes 64 in order to better define the holes 64 and locate the mesh layer 50 more securely. However, the mesh layer 50 should comprise a mesh structure 66 over at least the area aligned with the air inlet 56 and the gasket opening 62, in order that air drawn along the airflow path can pass from the air inlet 56 through the mesh structure 66 and the gasket opening 62 to the vaporization chamber 30.

As previously described, the average pore size of the mesh structure 66, the proportion of the area of the mesh structure 66 occupied by pores, and the surface material of the mesh structure 66 all combine to resist the flow of liquid in the opposite direction to the airflow, namely from the vaporization chamber 30 to the air inlet 56. It may be noted that the inwardly flowing air can also help to oppose the outward flow of liquid through the mesh layer 50. In the present embodiment, the mesh layer 50 is formed from stainless steel with a coating of PTFE. The average pore size of the mesh structure is approximately 10 μm.

When the first part 11 comprising the cartridge closure assembly is inserted into the second part 12 comprising the reservoir cover 26, the central opening 62 of the gasket 54 opens into the vaporization chamber 30. The gasket 54 is preferably formed from a resilient material such as silicone rubber in order to seal around the distal end of the vaporization chamber 30 and prevent air or liquid leaking between the first and second parts 11,12. A proximal surface of the gasket 54 may also be shaped to provide a seat for the heater coil 42.

The cartridge cover 52 comprises a pair of electrodes 67 exposed on its distal surface, which provide contacts for the vapour generating device to supply current to the heater coil 42. A pair of small apertures 68 in the gasket 54 allow the terminal wires 44 of the heater coil 42 to pass through the gasket 54 and make electrical contact with the electrodes 67. The mesh layer 50 may similarly be provided with small apertures (not illustrated) for the heater terminal wires 44 to pass through, or it may be possible simply to push the wires 44 through the mesh structure 66 of the mesh layer 50. In the illustrated embodiment, the electrodes 67 are also provided with apertures 70 for the heater terminal wires 44 to pass through, so that the terminal wires 44 may be welded or soldered to the electrodes 67 as a final step after assembly of the cartridge 10. Alternatively, the electrodes 67 could be provided with contacts (not illustrated) that extend in the proximal direction through the mesh layer 50 and gasket 54 to permit the contacts to be electrically connected to the heater terminals 44 before the cartridge 10 is assembled.

Figure 3:
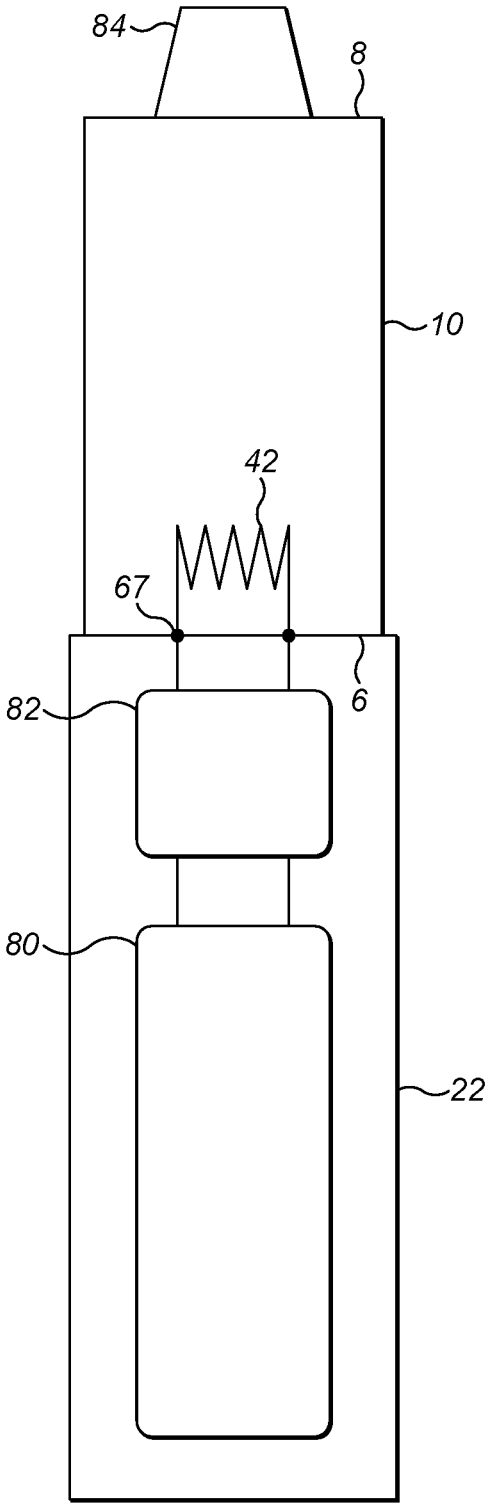
FIG. 3 is a schematic diagram of a vapour generating system that comprises a cartridge according to the present invention.

FIG. 3 schematically shows one possible configuration of a vapour generating system in accordance with the present invention. A vapour generating device 22 houses a power source 80, which provides power to a control circuit 82. The distal end of a cartridge 10 is releasably connected to the vapour generating device 22. There is a mouthpiece 84 at the proximal end of the cartridge 10, which may be attached to or integral with the cartridge 10. Electrodes 67 couple the power source 80, via the control circuit 82, to a heater 42 in the cartridge 10. Although the cartridge 10 and vapour generating device 22 are shown connected in an end-to-end configuration, it will be understood that in alternative embodiments of the invention the cartridge 10 could be releasably inserted inside the housing of the vapour generating device 22. In that case, the mouthpiece 84 could be attached to or integral with the vapour generating device 22 rather than the cartridge 10.

The invention claimed is:

1. A cartridge for a vapour generating system, the cartridge comprising:

an air inlet;

a vaporization chamber;

an air outlet;

an airflow path extending from the air inlet through the vaporization chamber to the air outlet; and a mesh disposed across the airflow path;

wherein at least a surface of the mesh comprises a water-repellent material, and wherein the cartridge further comprises a cartridge closure assembly, which comprises the air inlet, the mesh, a cartridge cover comprising the air inlet, a gasket, and a layer of the mesh mounted between the cartridge cover and the gasket.

2. The cartridge according to claim 1, wherein the water-repellent material is a ceramic coating.

3. The cartridge according to claim 2, wherein the ceramic coating comprises silicon dioxide.

4. The cartridge according to claim 1, wherein the water-repellent material is a fluoropolymer coating.

5. The cartridge according to claim 4, wherein the water-repellent material is PTFE.

6. The cartridge according to claim 1, further comprising a heater in the vaporization chamber, wherein the mesh is disposed such that a temperature of the mesh remains low enough to avoid thermal degradation of the water-repellent material when the heater is in operation.

7. The cartridge according to claim 6, wherein the temperature of the mesh remains below 270° C. when the heater is in operation.

8. The cartridge according to claim 1, wherein the mesh has an average pore size less than 50 μm.

9. The cartridge according to claim 1, wherein the mesh is disposed across the airflow path between the air inlet and the vaporization chamber.

10. The cartridge according to claim 1, wherein the gasket forms a seal around the vaporization chamber.

11. The cartridge according to claim 1, wherein the cartridge cover comprises integrated electrodes.

12. The cartridge according to claim 1, which is a three-part cartridge comprising:

the cartridge closure assembly as a first part;

a second part to which the cartridge closure assembly is attached, the second part comprising the vaporization chamber; and a third part to which the second part is attached, the third part comprising a reservoir for a vapour generating liquid.

13. A vapour generating system comprising the cartridge according to claim 1 and a vapour generating device comprising a power source;

wherein a distal end of the cartridge is releasably connected to the vapour generating device; and wherein electrodes couple the power source, via a control circuit, to a heater in the cartridge.

* * * * *